United States Patent [19]

Hankel

[11] 4,077,491

[45] Mar. 7, 1978

[54] ACOUSTICAL COMPOSITE

[75] Inventor: Keith M. Hankel, Dayton, Ohio

[73] Assignee: Acon, Inc., Dayton, Ohio

[21] Appl. No.: 718,220

[22] Filed: Aug. 27, 1976

[51] Int. Cl.[2] ..... E04B 1/99

[52] U.S. Cl. ..... 181/290

[58] Field of Search ..... 181/33 G

[56] References Cited

U.S. PATENT DOCUMENTS

| | | | |
|---|---|---|---|
| 3,082,143 | 3/1963 | Smith | 181/33 G |
| 3,322,233 | 5/1967 | McCluer et al. | 181/33 G |
| 3,748,799 | 7/1973 | Tough et al. | 181/33 G |
| 3,783,969 | 1/1974 | Pall | 181/33 G |
| 3,858,676 | 1/1975 | Masurier | 181/33 G |
| 3,977,492 | 8/1976 | Hankel | 181/33 G |

*Primary Examiner*—Brooks H. Hunt

*Attorney, Agent, or Firm*—Biebel, French & Nauman

[57] ABSTRACT

An improved acoustical material, which is simple in construction and uses conventional, inexpensive materials, for use as a lining material in association with noise generating machinery is disclosed. It comprises two woven fiberglass layers and an intermediate non-woven fibrous layer to form a composite which will not deteriorate, swell or retain oil, solvents, or water such as are found in machinery, and which has acoustical flow resistance of between 20 rayls and 80 rayls. The flexible composite may be used over a highly porous layer which is or acts as a dead air space relative to the composite.

5 Claims, 4 Drawing Figures

ACOUSTICAL COMPOSITE

CROSS-REFERENCE TO RELATED APPLICATIONS

Reference is made to my copending application Ser. No. 539,854 filed Jan. 14, 1975, and now U.S. Pat. No. 3,997,492 issued Aug. 31, 1976, the disclosure of which is specifically incorporated by reference.

BACKGROUND OF THE INVENTION

The invention relates generally to sound absorbent materials, and specifically to sound absorbent materials for industrial applications, such as linings on or inside enclosures around machinery.

Recently, increased attention has been focused on noise pollution, including that generated by the use of machinery, such as drills, lathes, and the like. Noise is a problem to the operator of the machine, as well as to those in the area where the machine is being operated. As a result efforts have and are being made to prevent or to reduce the noise level of machinery in order to provide a safer, quieter work area.

Attempts have been made to silence or to reduce machine noise by lining the inside of the machine, or housing surrounding the machine, with a material which will soak up or reduce the noise. It is important that the sound absorbent material be relatively inexpensive, in addition to being an efficient and effective sound absorber. If the material is too expensive, the expense will make its use prohibitive, even though it is efficient and effective, especially considering the number of machines which would use the material. Thus, an inexpensive material would find greater use, even where it was inefficient or would eventually become ineffective and have to be replaced, because of its low cost.

A typical lining material for machinery is open-cell polyurethane foam, which is a resistive sound absorber. It is a relatively inexpensive material, and it will reduce the noise level by providing a resistance to the passage of the sound emanating from the machine. But, open-cell polyurethane foam has a tendency to soak up oil and the like used to lubricate the machine. Once the cells of the sound-absorbent foam material fills with oil, the material becomes noise reflective, and so is inefficient and ineffective. Further, the accumulated oil represents a fire hazard. Another sound absorbent material is the non-woven fiberglass pad which is similar to open-cell foam in its operation, and likewise becomes ineffective and/or hazardous due to oil absorption.

Laminated acoustical material having a liquid resistant facing sheet is also known in the art. As an example, reference is made to McCluer U.S. Pat. No. 3,322,233 wherein a plastic film (1) is adhesively bonded (2) to a loosely woven fabric (3) which overlies a loose fibrous substance (4). As a backing there is a septum sheet including woven fabric (5) and an elastomeric substance (6) into which pellets (7) are embedded. However, in this type of arrangement, the loose fibrous substance (4) is required as the sound absorbent and the build-up of grime on the plastic film (1) will reduce the effectiveness of the laminate.

In a similar manner, in jet engine exhaust facilities it has become common practice to use a facing sheet over a honeycomb-type sound absorbing media. The facing sheet permits entry of sound woven therethrough for absorption by the absorbing media as the sound waves are trapped between a sound impervious backing and the facing sheet.

Examples of this type structure are found in U.S. Pat. Nos. 3,770,560 to Elder (perforated metal or plastic facing sheet); 3,374,234 to Wirt (perforated facing sheet); 3,700,067 to Dobbs (three dimensional acoustic face sheet 12); 3,630,312 to Woodward (four layer expanded metal mesh facing); 3,502,171 to Cowan (facing comprises at least two superposed and laminated woven cloth plies); 3,166,149 to Hulse (facing comprises an open-weave fiberglass screen bonded to a porous cloth or fabric layer), and 3,103,987 to Gildard (a laminate of glass fiber cloth sandwiched between layers of wire screen and faced with a perforated sheet).

My copending application Ser. No. 539,854 (now U.S. Pat. No. 3,977,492) also discloses the concept of using facing sheet over a dead air space. There, however, the facing is a composite used for acoustical flow resistance as well as for its ability to drain away solvents, oil and water.

Unlike the situation where a fast moving gas stream is to be encountered and a honeycomb required, the laminate of my copending application is more adaptable in its usage. The acoustical material claimed in that application is assembly of a composite comprising at least one layer of woven fiberglass cloth adhesively bonded to an open mesh wire screen and placed over a non-woven fibrous mat.

Still, there are situations when it is desirable to use a laminated composite alone, without a non-woven fibrous mat. In such instances, the composite, because of its acoustical resistance, may be used over any dead air space or may even be used alone in architectural applications. However, when so used an improved composite of increased flexibility is desirable.

Therefore, the need exists for an improved sound absorbing composite which may be used over a dead air space for industrial applications such as lining on the inside of machines or the enclosures around the machines as well as for architectural applications.

SUMMARY OF THE INVENTION

The improved composite of the present invention consists of two layers of woven fiberglass cloth each having a flow resistance of between 10 and 20 rayls and with a flexible intermediate layer of non-woven, fibrous, high temperature resistant, material such as polyester fill sandwiched therebetween. The acoustical flow resistance of the composite is between 20 and 80 rayls.

When used for industrial applications, it should be used over a dead air space. This dead air space may be a honeycomb material; a non-woven animal, mineral or vegetable fiber mat having a binder therein; or other spacer material providing a dead air space of approximately 1–2 inches. When used as an architectural covering, it may be bonded directly to the wall or ceiling by, for example, stapling, gluing or nailing.

The lamina of the composite itself may be adhered together in various ways, but the preferred manner is by sewing. By patterning the stitching to form discrete areas it is possible to produce not only a decorative acoustical mterial, but also to introduce "fire walls" into the laminated composite. That is, the composite itself is made out of fire-resistant material; however, if the non-woven fibrous materials become oil soaked it might possibly be ignitable. Even in that event, the fire will spread only to the point where there is stitching. This is because at the sewn points the two woven fiberglass cloth layers are drawn together compressing the non-woven fibrous material and creating a "fire wall" which cuts off oxygen entry and resists the spread of the flame.

Another fire resisting feature of the composite of the present invention is that most contaminants that splash on the surface of the composite drain directly and quickly back to the source without being soaked up. What little contaminate may seep through the woven fiberglass cloth outer surface also drains back quickly to the source along the inside surface of the fiberglass cloth.

Since the woven fiberglass cloth pores do not absorb flammable oils or solvents, there is less chance of combustion. Likewise, there is less build-up of contaminants which may affect the sound absorption capabilities of the acoustical material. In any event, it can be cleaned without any loss of acoustical characteristics by use of steam or water spray.

In its simplicity of construction, which uses conventional, inexpensive material, the composite of the present invention provides an inexpensive sound absorbent material. It will not deteriorate, swell, or retain solvents, oil or water from the machine on which it is being used. It withstands high temperatue and maintains a high degree of structural integrity. And yet, because it is made of lightweight and flexible lamina, the composite can be readily bent and shaped to follow intricate curves and contours. Further, when used over a dead air space such as a non-woven mat, the assembly of composite and dead air space results in absorption coefficiency which excel those generally obtained with equal thickness of the ordinary resistive type sound absorbers, such as foams or random-oriented fiberglass filaments.

It is therefore an object of this invention to provide an improved sound absorbent composite which is inexpensive, safe, effective, and adaptable for use over a dead air space for lining the inside of an enclosure around machinery or alone as an architectural covering.

Other objects and advantages of the invention will be apparent from the following description, the accompanying drawing and the appended claims.

DESCRIPTION OF THE PREFERRRED EMBODIMENT

Figure 1:
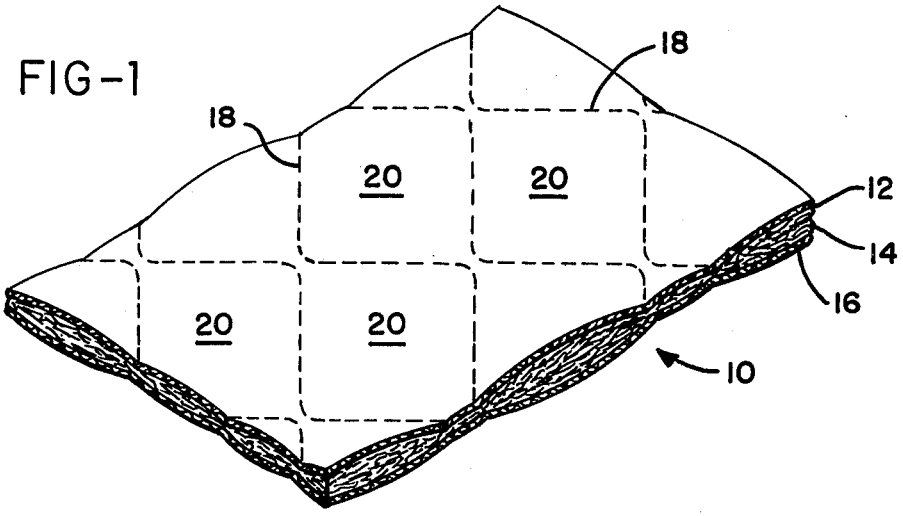
FIG. 1 is a perspective view of the preferred acoustical composite of the present invention.

The acoustical composite of the invention shown generally at 10 in FIG. 1 comprises a first woven fiberglass cloth layer 12, an intermediate layer 14 of non-woven fibrous material, and a second woven fiberglass cloth layer 16.

The woven fiberglass cloth of layers 12 and 16 can be any conventional, commercially available fiberglass cloth having a thickness of between about 0.001 inch and 0.010 inch, a weight of between about one and five ounces per square yard, and an acoustical flow resistance of between about 10 rayls and 20 rayls. There is no criticality in the woven pattern yarn size or twist or finish. The finish will depend to some extent on the end of the fabric, as the finish is primarily for the purpose of aiding the bond of the fabric to other materials, improving the lubricity and high temperature abrasion resistance of the fabric and stabilizing the weave.

Examples of woven fiberglass fabrics suitable for use in the acoustical materials of the invention are the following, which are made by Burlington Glass Fabrics Company, a division of Burlington Industries:

| Style | Finish | Piece Number |
|---|---|---|
| 392/56 | AM 42 | 247024 |
| 392/52 | AM 44 | 247027 |
| 392/56 | AM 43 | 247032 |
| 392/56 | AM 42 | 247025 |
| 392/52 | AM 44 | 247030 |

The non-woven fibrous layer 14 is preferably a Fortrel polyester fill available from Celanese, but may be any other type of flexible, fire-resistant non-woven fibrous material of high porosity. Intermediate layer 14 may range in thickness (uncompressed) from $\frac{1}{8}$ to $\frac{3}{4}$ inch. Its purpose is primarily to serve as a spacer between the two woven fiberglass cloth layers 12 and 16. In this manner the sound absorption of the composite is synergistically improved, even though the non-woven fibrous material adds little sound absorbency to the composite.

As mentioned the total acoustical flow resistance of the composite is between 20 and 80 rayls. This is achieved with a composite having a total thickness of between $\frac{1}{8}$ and $\frac{3}{4}$ inch and a total weight of between 1 oz/sq.ft. and 4 oz/sq/ft. Of course at the compressed points where the three layers are joined, the thickness will be less. The tree layers are preferably joined by sewing through all three, although other methods such as adhesive bonding could be used. However, sewing offers the "fire wall" advantages previously mentioned.

This principle is illustrated by reference to FIG. 1 where stitching 18 is shown patterned over the face of the composite 10. This forms discrete areas 20, essentially bound on all sides by stitching. At the point of stitching the loose non-woven fibrous material 14 is compressed, and as previously discussed this forms a "fire wall" which will not support a flame.

Of course, the materials of the composite are fire resistant in their original form and will combust only if soaked with a flammable liquid. Such oil and solvent absorption is, however, lessened by the preferred structure of the composite as also discussed previously.

Another important feature of the acoustical composite of the present invention is that it can be readily bent and shaped to follow intricate curves and contours. Much of thix flexibility results from the soft, flexible nature of the non-woven fibrous material 14. The woven fiberglass layers 12 and 16 contribute to the structural integrity of the composite and are not as pliable as the intermediate layer 14.

This flexibility makes the instant composite ideally suited for architectural applications where a soft, decorative, sound absorbing covering is required. Its primary use, however, is in lining noise generating machinery. It can be installed in two ways: (1) directly inside housings surrounding the noise source, such as existing machine bases or castings or cabinets, or (2) attached to auxiliary panels installed within the machinery. A dead air space must be provided in either of these latter applications.

Figure 2:
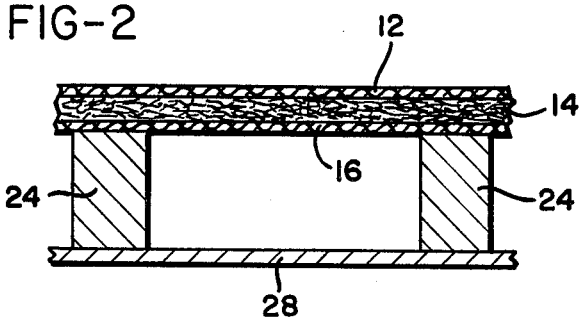
FIGS. 2–4 are cross-sectional views showing use of the acoustical composite of FIG. 1 in conjunction with several types of dead air spaces to form an acoustical assembly.
Figure 3:
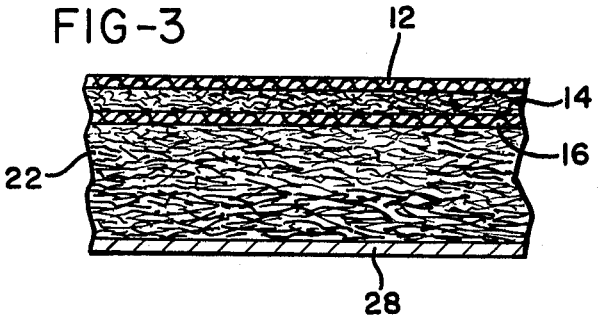
Figure 4:
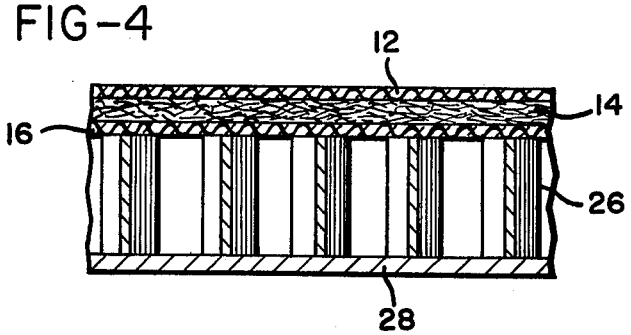

FIGS. 2–4 illustrate various types of dead air spaces which can be used. Preferred is use of a non-woven fibrous mat 22 (FIG. 3).

The non-woven fibrous mat 22 is an open, highly porous layer which offers essentially no acoustical flow resistance, especially compared to the composite 10. Normally, it will determine the overall thickness of the acoustical assembly, since it comprises the predominant amount of the total thickness, and so preferably varies from approximately one to two inches, while the total thickness of the assembly varies from approximately $1\frac{1}{8}$ to $2\frac{3}{4}$ inches. One suitable material for mat 22 is non-woven hog hair fiber mat having a latex of neoprene binder, such as Paratex, a rubberized curled hair sheet sold by Blocksom & Company, Michigan City, Ind. Other conventional, commercially available highly porous materials are acceptable as long as they act like or create a dead air space.

Alternatively, the dead air space could be provided by spacers 24 (FIG. 2) or a honeycomb material 26 (FIG. 4). In any event, the composite is spaced approximately 1 to 2 inches from the wall 28 of the machinery, but could be spaced anywhere up to 12 inches away for architectural uses. Standard industrial fasteners, spot-welded stud-type prongs, or heavy duty adhesives can be used to attach the composite 10 to enclosure panels and air gas frames. The same type fasteners can be used to fasten the acoustical assembly including the backing-spacer to the wall 28.

The composite 10 may be made by various processes. Sheets of woven fiberglass cloth layers 12 and 16 and intermediate layer 14 may be assembled by hand and sewn together or continuous webs of these materials may be automatically unwound from supply rolls, joined and sewn together. When a fibrous mat 22 is bonded to composite 10 to form an acoustical assembly, this may be done as disclosed in copending application Ser. No. 539,584 (U.S. Pat. No. 3,977,492). In this manner an improved sound absorbing composite is produced.

While the products herein described constitute preferred embodiments of the invention, it is to be understood that the invention is not limited to these precise products, and that changes may be made therein without departing from the scope of the invention which is defined in the appended claims.

What is claimed is:

1. An acoustical composite capable of being readily bent and shaped to follow intricate curves and contours consisting of:

a. two layers of woven fiberglass cloth, each having an acoustical flow resistance of between 10 rayls and 20 rayls, and b. a flexible, porous, non-woven, fibrous material sandwiched between said woven fiberglass cloth layers and bonded thereto, said composite having a total thickness of between about $\frac{1}{8}$ and $\frac{3}{4}$ inch and a total weight of between about 1 ounce per square foot and 4 ounces per square foot and a total acoustical flow resistance of between 20 rayls and 80 rayls and being resistant to fire, deterioration, swelling, and liquid retention.

2. An acoustical composite as set forth in claim 1 wherein said flexible, porous, non-woven, fibrous material is a polyester fill.

3. An acoustical composite as set forth in claim 2 wherein said composite is sewn together with the stitching forming discrete patterned areas.

4. An acoustical assembly for use as a lining material in association with noise generating machinery consisting of:

a. a composite capable of being readily bent and shaped to follow intricate curves and contours consisting of two layers of woven fiberglass cloth, each having an acoustical flow resistance of between 10 rayls and 20 rayls and a flexible, porous, non-woven, fibrous material sandwiched between said woven fiberglass cloth layers and bonded thereto, said composite having a total thickness of between about $\frac{1}{8}$ and $\frac{3}{4}$ inch and a total weight of between about one ounce per square foot and four ounces per square foot and a total acoustical flow resistance of between 20 rayls and 80 rayls and being resistant to fire, deterioration, swelling, liquid retention and other adverse conditions as may be found in said noise generating machinery, and b. a highly porous non-woven fibrous mat having a binder therein joined to said composite and serving as a dead air space relative thereto.

5. An acoustical assembly as in claim 4 wherein the acoustical assembly has a total thickness of between approximately $1\frac{1}{8}$ inch and approximately $2\frac{3}{4}$ inches.

* * * * *